US005261555A

United States Patent [19]

Rogers et al.

[11] Patent Number: 5,261,555

[45] Date of Patent: Nov. 16, 1993

[54] INSULATED STRUCTURE

[75] Inventors: James D. Rogers, Mantua; Hugh H. Storms, North Canton, both of Ohio

[73] Assignee: Eltech Systems Corporation, Boca Raton, Fla.

[21] Appl. No.: 865,416

[22] Filed: Apr. 8, 1992

[51] Int. Cl.[5] ..... B27B 7/00

[52] U.S. Cl. ..... 220/469; 138/149; 432/103

[58] Field of Search ..... 29/525.1; 138/147, 149; 220/466, 469; 432/103; 165/135

[56] References Cited

U.S. PATENT DOCUMENTS

| | | | |
|---|---|---|---|
| 2,266,134 | 12/1941 | Wachowitz | 220/466 X |
| 3,045,858 | 7/1962 | Söhngen | 220/469 |
| 3,291,437 | 12/1966 | Bowden et al. | 29/525.1 X |
| 4,715,513 | 12/1987 | Shelton, Sr. | 220/469 |
| 4,815,969 | 3/1989 | Anderson | 432/103 |
| 4,932,863 | 6/1990 | Anderson | 432/115 |

FOREIGN PATENT DOCUMENTS

| | | | |
|---|---|---|---|
| 65796 | 5/1980 | Japan | 29/525.1 |

OTHER PUBLICATIONS

Kaowool FireMaster Fire Protection, p. 17.
Kaowool Processed Blanket Products, p. 14.

*Primary Examiner*—Joseph M. Gorski
*Attorney, Agent, or Firm*—John J. Freer

[57] ABSTRACT

An insulated structure, typically a drum, can initially have an outer uninsulated wall of heat conductive material. The outer wall, such as the outer cylindrical wall of a drum, may then be insulated with insulation supplied as panels. Each panel covers a part of the surface, e.g., extends part way around a portion of the circumference of a drum. Each panel connects, end-to-end, to at least one other insulation panel. Adjacent panels are advantageously joined end-to-end by adjustable joining means. Each panel has an outer metal sheet, such as of galvanized steel. This sheet has an inner layer of ceramic fiber insulation bonded to it. In addition to being attached to each other, panels may also be secured to the wall.

13 Claims, 2 Drawing Sheets

INSULATED STRUCTURE

BACKGROUND OF THE INVENTION

A variety of structures, including cylindrically-shaped structures such as drums, have heat conductive walls to which insulation may be applied to the exterior, e.g., the weather side, of the cylinder. For example, a drum dryer for use in making bituminous concrete asphalt may have a heat loss reduction insulation cover. Thus, in U.S. Pat. No. 4,932,863 there is disclosed an insulation jacket for such a dryer. The jacket is wrapped around the outer peripheral surface of the drum dryer wall. The jacket can have an aluminum sheath with ceramic fiber being bonded to the sheath. The jacket is secured by bands of strapping wrapped around the jacket.

It would be desirable to provide such an insulation structure that could have not only snug fit on installation, but which would also make available ease of adjustment of fit in service. It would also be desirable to have an insulation jacket which takes into consideration ready repair, such as ease of disassembly as well as assembly, without deleterious loss of insulation quality after repair.

SUMMARY OF THE INVENTION

An insulation structure has now been devised which provides the strength and durability of previous structures, but now also offers an insulation jacket of particular ease of repair. The present system especially affords snug insulation fit during both installation and service. The insulation structure provides excellent heat retention, such as within a drum dryer, particularly reducing radiant heat loss from the heat conductive drum wall. The present structure also makes available especial ease of assembly and disassembly.

In one broad aspect, the invention is generally directed to an insulated structure which has a wall of heat conductive material, with the structure having insulation on the outside surface of the wall, with the improvement in the insulation comprising multiple insulation panels applied in conformity to the outer wall surface, each insulation panel extending over a portion only of the wall surface, with each panel being joined end-to-end to at least one adjacent panel extending over the wall surface, with each of the insulation panels comprising an outer metal sheet and an inner layer of ceramic fiber insulation bonded to such metal sheet.

In one particular aspect, the invention is directed to an insulated drum having a cylindrical drum wall. The insulation panels each extend circumferentially part way around the outer wall surface of the drum, whereby panels, joined end-to-end, extend circumferentially fully around the drum outer wall surface.

In another aspect, the invention is directed to a flexible insulation panel adapted for connecting end-to-end to adjacent insulation panels on, and in conformity with, the outer peripheral surface of a structure to be insulated, the flexible insulation panel having four sides and an at least general quadrilateral shape, with at least one panel end being adapted for abutting end-to-end with the end of at least one adjacent flexible insulation panel, with each panel comprising an outer thin metal sheet having sufficient flexibility to conform by flexing onto the outer peripheral surface of the structure to be insulated, with such panel comprising an inner layer of ceramic fiber insulation, with at least one end of the panel having an extension section of the thin metal sheet, which extension section extends beyond the inner layer of ceramic fiber insulation at the panel edge.

In yet another aspect, the invention is directed to a method of insulating an object having a wall of heat conductive material, with insulation being applied on a surface of such wall. A still further aspect of the invention is directed to repair of insulated walls, which repair can involve ease of removal, as well as ease of reapplication, of insulation to a wall surface.

DESCRIPTION OF THE PREFERRED EMBODIMENTS

Figure 1:
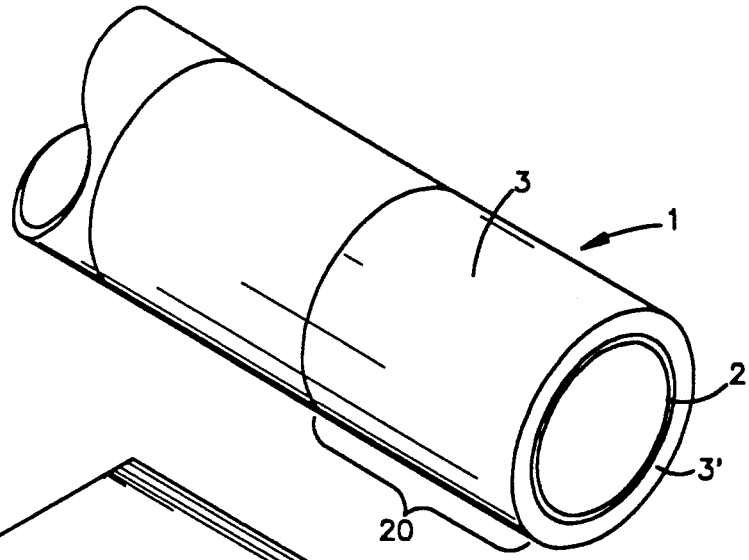
FIG. 1 is a perspective view of an insulated drum constructed in accordance with the present invention.

As the term is used herein, an insulation "panel" of the present invention has ceramic fiber insulation that is used with a thin metal sheet backing. This will usually be a sheet of steel or galvanized steel, but aluminum or stainless steel may be employed, with galvanized steel being preferred. The sheet backing should be sufficiently thin so as to permit ready flexing of the panel onto a curved outer surface, such as a drum wall, but also should be sufficiently rugged for heavy industrial use. Typically, galvanized steel of from 14 to 28 gauge, i.e., which has a thickness of from less than 0.02 up to about 0.08 inch, will be serviceable and combine manual flexing with ruggedness for the panel. Preferably a galvanized steel panel of about 22–24 gauge is used.

It is contemplated that the panel will usually have at least a general quadrilateral shape, although other shapes may be used. In its usual shape, preferably a rectangular shape, the panel will have four sides with opposing sides being parallel. It is understood that the metal sheet backing may extend beyond, or be even with, or be recessed from, the fiber insulation at any or all panel edges.

For adhesively bonding the ceramic fiber insulation to the metal sheet backing, there may be used a silicate such as sodium silicate, or there can be used colloidal silica, or organic glues where lower temperature application is contemplated, as well as cements. Typically, the adhesive is simply coated on the metal sheet and the fiber in blanket form is pressed onto the adhesive. It may be desirable to maintain the blanket under moderate pressure while the adhesive is permitted to air dry. Generally, the depth of fiber under the metal sheet will be within the range of from about one inch to about six inches, and more often from about 2–6 inches.

The insulation panels of the invention will be applied to a structure. Such structure, e.g., a container or similar manufacture, can be generally any such structure having a wall susceptible of being insulated with ceramic fiber. The structure will usually be a large, typically at least substantially cylindrical, internally-heated structure. It may be internally heated, as by a burner. Thus, representative structures for insulation may be gravity-flow or counter-flow dryers, such as will be useful for preparing bituminous concrete asphalt. Other structures include stationary asphalt heaters, rotary dryers for sand, gravel, soil and other materials where water content is to be reduced, such as by using heated air. In general, the structure, such as a container or similar manufacture will be referred to herein by way of example, and for convenience, simply as a "drum" and a wall usually as a "drum wall". The insulation panels applied to the structure may be referred to herein as an insulation "jacket".

The insulation utilized will be a ceramic fiber insulation, most always a silica-containing fiber. Such ceramic fiber may be other than silica-containing fiber, as represented by alumina fiber. The silica-containing fiber may simply be silica fiber, although usually the silica is present with one or more of alumina, zirconia, chromia, or titania. Such silica-containing fibers are also meant to include fibers from silicon nitride, silicon carbide, calcium-aluminum silicate and the like. It is to be understood that the fiber will most always be all ceramic fiber. If not all ceramic fiber, the fiber should be at least a major amount ceramic fiber, i.e., greater than 50 weight percent, of ceramic fiber. The balance or minor amount, i.e., under 50 weight percent, can be other synthetic or natural mineral fiber, e.g., glass fiber or mineral wool, including mineral wool with additives.

It will be understood that the ceramic fiber may be prepared by any process useful for preparing ceramic fiber. The fibers will be in bulk form, often needled or stitched together to have a more structured form. These resulting, structured form fibers, usually when next cut into insulation units, may be referred to herein as being in "mat" form, or as being "blankets".

Referring then to FIG. 1, there is shown a drum 1 comprised of a cylindrical drum wall 2. Around the cylindrical drum wall 2 are a series of insulation panels 3. For the drum depicted, a set of two insulation panels 3, 3' are sufficient to extend the insulation around of the complete circumference of the drum 1. That is, for this drum 1 each insulation panel 3 insulates ½-way around the cylindrical drum wall 2. Each insulation panel 3 is therefore attached end-to-end, at each end, with only one other panel 3', which other panel 3' is a mirror image insulation panel. For the portion of the drum 1 depicted in the figure, the insulation panels 3, 3' are placed axially along the drum 1 in sections 20. Thus, in addition to each insulation panel 3 abutting end-to-end with a mirror image insulation panel 3', each insulation panel 3 abuts side-by-side with at least one adjacent insulation panel 3. By this side-by-side relationship, the entire heat conductive outer surface of the drum wall 2 can be insulated with sections 20 of insulation panels.

Figure 2:
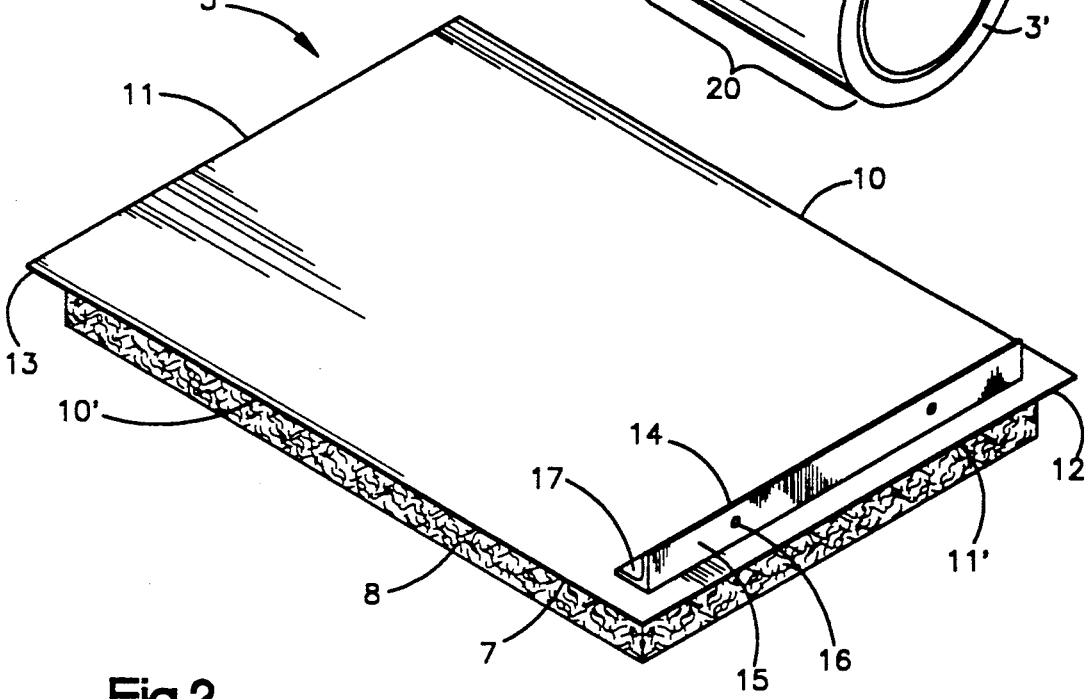
FIG. 2 is a perspective view of one form of insulation panel for use in insulating the drum of FIG. 1.

FIG. 2 shows an insulation panel 3 of preferred rectangular shape having sides 10, 10' and ends 11, 11'. In general, when referring herein to a preferred panel of rectangular shape, the long edges will be referred to as "sides" and the short edges as "ends". This insulation panel 3 has an outer metal sheet 7 over a layer of ceramic fiber insulation 8. At one side 10 the outer metal sheet 7 extends beyond the ceramic fiber insulation 8 and thereby provides a sheet side extension 12. Likewise, at one end 11 the outer metal sheet 7 extends beyond the ceramic fiber insulation 8 and provides a sheet end extension 13. Furthermore, atop the outer metal sheet 7, at one end 11', there is an angle fastening member 14. This angle fastening member 14 extends along essentially the full width dimension of the outer metal sheet 7 adjacent to and parallel with the panel end 11'. This angle fastening member 14 has a raised section 15, containing apertures 16 and a lower section 17 which is adhered to the outer metal sheet 7, e.g., as by welding.

Figure 3:
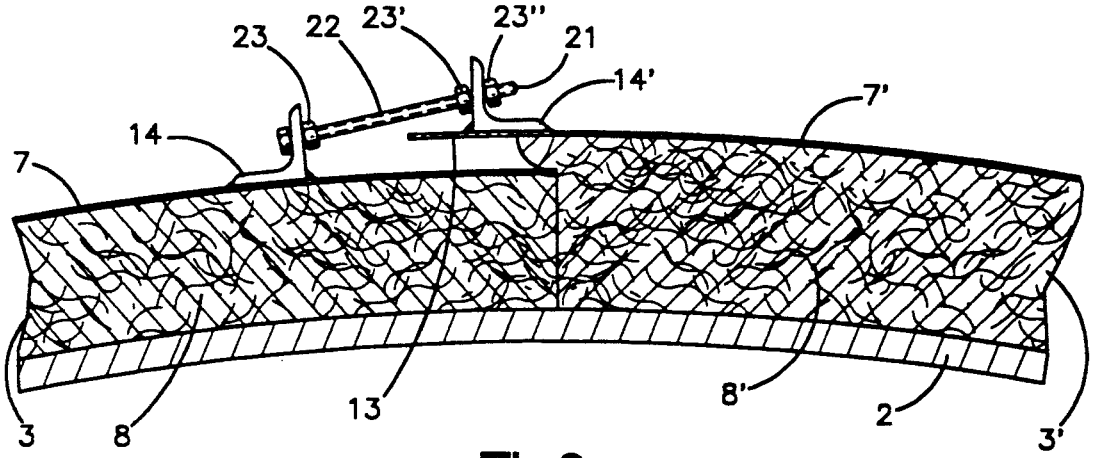
FIG. 3 is a fragmentary vertical section of adjustable engagement means for two adjacent panels connected end-to-end.

In FIG. 3, two insulation panels 3, 3' are compressed together in an adjustable joint by abutting against one another end-to-end along a cylindrical drum wall 2. For these panels 3, 3' one panel 3' has an outer metal sheet 7' having an outer metal sheet end extension 13. The adjacent panel 3 has ceramic fiber 8 extend to the edge of its outer metal sheet 7. This end extension 13 is thereby slipped over the outer metal sheet 7 of the adjacent panel 3 at the joint. Also, this end extension 13 has an angle member 14' and the end of the adjacent outer metal sheet 7 has an opposing angle member 14. Connecting these members 14, 14' is adjustable fastening means 21. This adjustable fastening means 21 has a bolt 22 and a set of nuts 23, 23' and 23''. The double nutting 23', 23'' at the one end of the bolt 22 is preferred to retard or prevent loosening of the fastening means 21 in use. This adjustable fastening means 21 permits tightening of the insulation panels 3, 3' against one another at the joint and provides for compression of the fiber insulation 8, 8' to achieve an enhanced heat seal joint.

Figure 4:
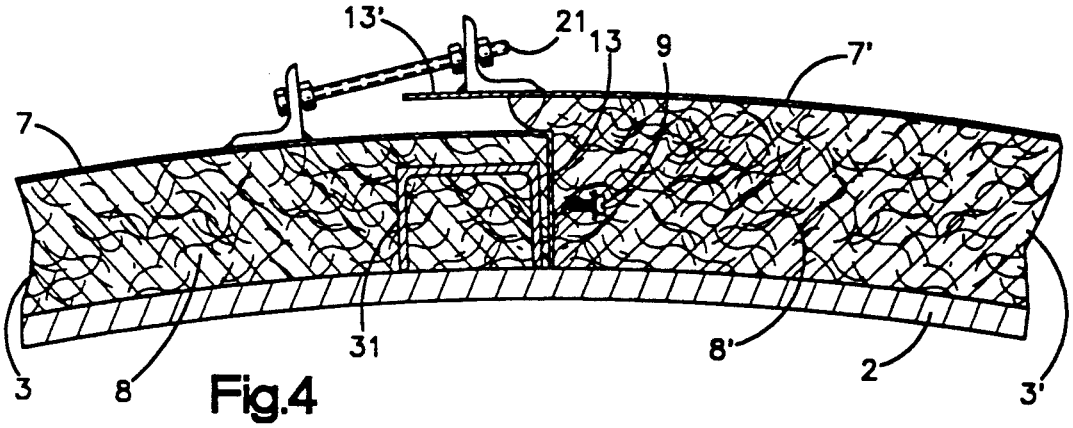
FIG. 4 is a partially exploded, fragmentary vertical section of two adjacent panel ends in adjustable engagement and connected with drum attachment means.

Referring then to FIG. 4, two insulation panels 3, 3' meet end-to-end under adjustable fastening means 21 and at panel anchoring means 31. Each of the insulation panels 3, 3' meet end-to-end over a cylindrical drum wall 2. These panels 3, 3' each have an outer metal sheet 7, 7' over a layer of ceramic fiber insulation 8, 8'. Each outer metal sheet 7, 7' has an end extension 13, 13'. The end extension 13 for the outer metal sheet 7 is in direct contact with the panel anchoring means 31. The extension 13 is bent so that it angles around two faces of the panel anchoring means 31, which may also be termed herein a "wrap around" connection. This end extension 13 is then secured to the panel anchoring means 31 by means of a fastener 9. This panel anchoring means 31 is filled with ceramic fiber, as shown in the Figure, before mounting on the drum wall 2. For the adjacent panel 3' the end extension 13' then sits atop the other end extension 13 at the upper surface of the panel anchoring means 31. This end extension 13' can be secured to this upper surface of the panel anchoring means 31 by fastening means (not shown). On the drum wall 2 the anchoring means 31 will generally extend in an axial direction in relation to the drum. As it was for the joint of FIG. 3, the abutting panels 3, 3' of FIG. 4 are in adjustable contact whereby they can be adjustably compressed together by the adjustable fastening means 21 to form a snug heat seal joint.

Figure 5:
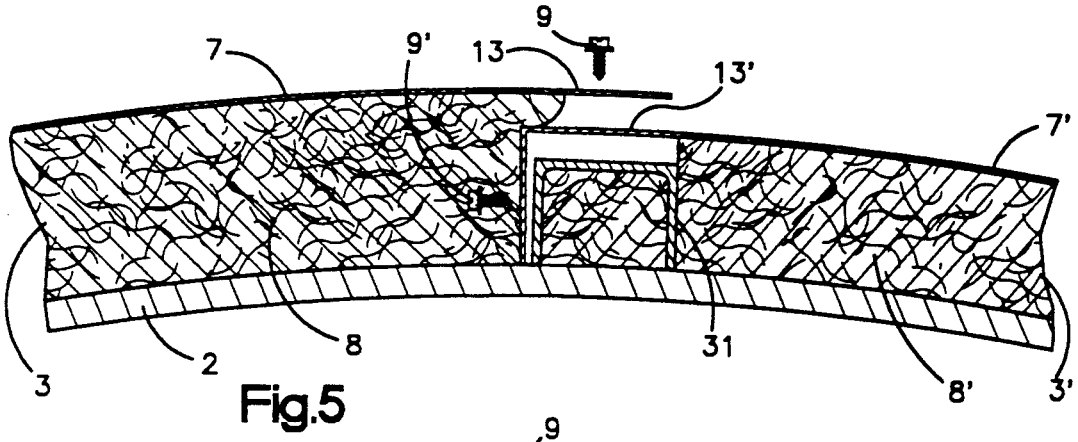
FIG. 5 is an exploded, fragmentary vertical section of adjacent panel ends and drum attachment means.

Referring then to FIG. 5, two insulation panels 3, 3' are shown in snug fit over a cylindrical drum wall 2. The insulation panels 3, 3' abut end-to-end and against a panel anchoring means 31. The panel anchoring means 31 is secured to the cylindrical drum wall 2 such as by welding. For one insulation panel 3, the outer metal sheet 7 has an extension 13 that extends over the top of the panel anchoring means 31. For the adjacent, abutting insulation panel 3', the outer metal sheet 7' has an extension 13' that extends over and around two outer surfaces of the panel anchoring means 31. For both panels 3, 3' the ceramic fiber insulation 8, 8' abuts snugly up against the panel anchoring means 31. Fasteners 9, 9' are then used to secure the outer metal sheet extensions 13, 13' to the panel anchoring means 31.

Figure 6:
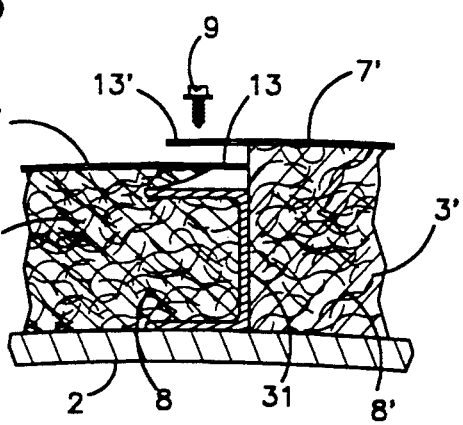
FIG. 6 is a variation in the drum attachment means of FIG. 5.

In FIG. 6, panels 3, 3' abut end-to-end over a cylindrical drum wall 2. In the variation depicted in this figure, the panels 3, 3' abut at panel anchoring means 31, but the anchoring means 31 is on its side and secured to the cylindrical drum wall 2, such as by welding. For this fastening arrangement, the extensions 13, 13' of the sheets 7, 7' merely overlap the upper surface of the anchoring means 31. In this overlap, they are secured to the upper surface of the anchoring means 31 by a fastener 9. For both panels 3, 3', the ceramic fiber insulation layers 8, 8' abut snugly up against the panel anchoring means 31.

Figure 7:
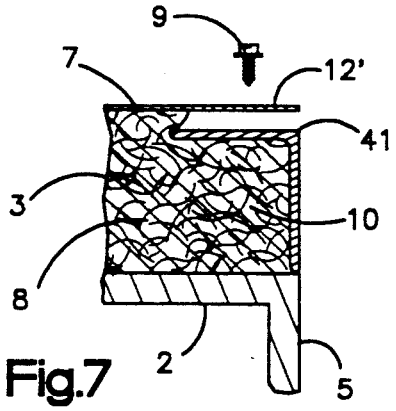
FIG. 7 is a partially exploded, vertical cross-section of a panel side connected with drum attachment means at a drum end.

Referring then to FIG. 7, there is shown an insulation panel 3 of outer metal sheet 7 and insulation layer 8. The panel 3 has a side 10 which is brought to the edge beyond the end wall 5 of a cylindrical drum wall 2. The outer metal sheet 7 of this panel 3 has a sheet side 12' which runs across the top of a panel side anchoring means 41. With the sheet side 12' across the top of the anchoring means 41, ceramic fiber insulation 8 fills in the space under the anchoring means 41. To accomplish this, the insulation 8 can be slit at the side 12' of the panel 3, or adhesive can be left off the edge of the metal sheet 7 when the panel 3 is made. The side anchoring means 41 forms an extension of the end wall 5 of the drum. The sheet side extension 12 is secured to the top surface of the side anchoring means 41 by a fastener 9.

Figure 8:
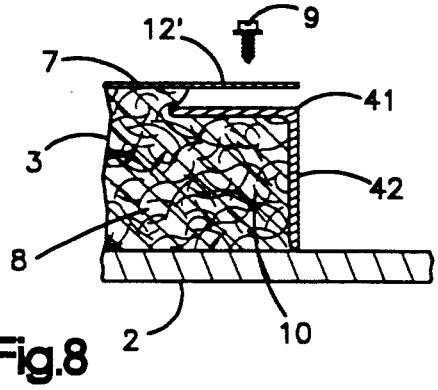
FIG. 8 is a variation of FIG. 7, not at a drum end.

In FIG. 8, a panel 3 is secured over a cylindrical drum wall 2, but at an area along the drum wall 2, not at an end of the drum. Again, as for the anchoring in FIG. 7, the panel 3 in FIG. 8 has a sheet 7 with a side 12' which extends over a side anchoring means 41 and is secured thereto by means of a fastener 9. In this way, a panel 3 on drum wall 2 can be fastened to the drum wall at the panel side 10. The ceramic fiber insulation layer 8 of the panel side 10 thus abuts up against one side of the depending leg 42 of the anchoring means 41. Also there can be placed, and abutted up against the open side of the leg 42, the side of an adjacent insulation panel (not shown). The anchoring means 41 can extend circumferentially around the drum wall 2 and may be referred to herein as anchoring rib means 41.

In preparing a drum wall for installing panels 3, channel anchoring means 31 can first be secured to the drum wall 2. Panels 3, 3' abut against the anchoring means 31 and are fastened thereto in the manner such as shown in FIG. 5. This initiates the application of panels 3, 3' around a section of the drum and anchors the panels 3, 3' to the drum. At the ends of the panels 3, 3' opposite where they are secured to the panel anchoring means 31, the panels 3, 3' can be secured to one another, in end-to-end contact as shown in FIG. 3. That is, for these ends opposite the anchoring means 31, the opposite ends can be secured to one another by adjustable fastening means 21. By this method of construction, in each panel section 20 the panels 3 are secured to the drum wall 2 and are also provided with adjustable fastening means. The adjustable fastening means not only firmly compresses the fiber 8 of the panels 3, 3' to the drum wall 2, but also firmly bring panels 3, 3' together for snug heat seal joints. Moreover, these heat seal joints can be maintained in snug relationship by adjustment of the fastening means 21 during extended use of the drum 1.

As noted before, in addition to anchoring the panels 3 by panel anchoring means 31 at the panel ends to the drum wall 2, the panels 3 may also be anchored at their sides to the drum wall 2 as shown in FIGS. 7 and 8. But the panels 3 will be anchored at their sides last, to permit these panels 3 to be first adjusted and then fastened at their ends, such as shown in FIG. 3. Panels may thus be made exactly as shown in FIG. 2, with both sheet side extensions 12 and sheet end extensions 13. However, it is to be understood that a great variety of panel configurations is contemplated. For example, a panel 3 may have side extensions 12 on both sides, or have no side extension 12. Moreover, a panel may have no sheet end extensions 13, or could have such extensions 13 at both ends. As seen from FIG. 4, some sheet end extensions 13 for wrap around connection may be essentially twice the length of extensions that merely connect on top of a panel anchoring means 31. It is to be understood that at connections between sheet end and side extensions with anchoring means, sealants or caulks and the like can be used to provide a weather tight seal, as is known in the art.

It is contemplated that each panel end could be equipped with an angle fastening member 14. A panel 3 equipped in this manner could be in adjustable tension with adjoining panels at each panel end. The fastening member 14 need not be an angle and need not extend across the panel width. For example eyelets could be welded to the sheet 7 and serve as retainers for the fasteners 21. It is to be understood that for the adjustable fastening means, fasteners will preferably be threaded fasteners such as the nuts and bolts which are depicted in the figures. Furthermore, although the fasteners 9 have been shown as screws, other fastening means would be suitable such as studs or rivets.

It is to be understood that the insulation jacket of the present invention can be constructed for ready repair. Thus, although the connection as shown in FIG. 5 could be, for example, welded connections between the outer metal sheets and the panel anchoring means, for ease of repair there are preferably used mechanically releasable fasteners such as have been shown in the figure. Furthermore, with the adjustable fasteners, panels which abut one another at their edges need merely be unbolted. After this, and after unfastening panels from anchoring means, including side anchoring means, used panels can then be readily removed. Fresh panels can then be inserted for used panels by reversing this procedure, e.g., the panels can be anchored to edge and side anchoring means.

Angles, channels, and fasteners will typically be made of steel or stainless steel. Angles and channels can be secured in place by any means for fastening metal parts together, such as by welding. Channel members are preferred for use as panel anchoring means 31, and are preferred in the form and positioning as depicted in FIG. 5 for their self-centering characteristic. To insulate these channel members, strips of ceramic fiber blanket can be merely force fit into the channel, or they can be adhesively affixed within the channel. However, other anchoring members other than channel members are contemplated, e.g., I-beam and T-bar members. The use of such is also contemplated for the side anchoring means 41 of FIGS. 7 and 8.

We claim:

1. In an insulated drum which has a cylindrical drum wall of heat conductive material, and which has insulation on an outer peripheral surface of the drum, the improvement in said insulation comprising anchoring means secured to said outer peripheral surface of said drum, multiple insulation panels applied in conformity to said outer peripheral surface, with at least some of said panels attached to said anchoring means, each insulation panel extending circumferentially part way around a portion of said outer peripheral surface, with each panel being joined end-to-end to at least one adjacent panel extending circumferentially part way around said outer peripheral surface, with each of said insulation panels comprising an outer metal sheet and an inner layer of ceramic fiber insulation bonded to said metal sheet, said metal sheet for at least some panels having an extension section which extends at one end of said panel beyond said inner layer of ceramic fiber and for at least some panels extends over said anchoring means.

2. The insulated drum of claim 1, wherein each insulation panel is joined at each end to adjacent insulation panels forming a series of panels extending completely around the circumference of said outer peripheral surface.

3. The insulated drum of claim 1, wherein said anchoring means comprises a metal member, said member is welded to said peripheral surface and said panel is mechanically attached to said member.

4. The insulated drum of claim 1, wherein said anchoring means comprises a channel member and said channel member if filled with ceramic fiber insulation.

5. The insulated drum of claim 1, wherein each insulation panel has an outer metal sheet selected from the group consisting of steel, galvanized steel, stainless steel and aluminum.

6. The insulated drum of claim 5, wherein said outer metal sheet is from about 14 to about 28 gauge metal.

7. The insulated drum of claim 1, wherein at least some adjacent panels are joined with adjustable fastening means in tension, said panels being positioned end-to-end to one another.

8. The insulated drum of claim 7, wherein said adjustable fastening means comprise threaded fasteners.

9. The insulated drum of claim 1, wherein said wall of heat conductive material is a wall of steel or stainless steel.

10. The insulated drum of claim 1, wherein said outer metal sheet is adhesively bonded to said inner layer of ceramic fiber insulation.

11. The insulated drum of claim 10, wherein the adhesive for said bonding is selected from the group consisting of sodium silicate and colloidal silica.

12. The insulated drum of claim 10, wherein the depth of the inner layer of said insulation is within the range from about one inch to about six inches.

13. A drum which has a cylindrical drum wall of heat conductive material, with the drum being adapted for application of insulation panels on an outer peripheral surface of the drum wall, said drum being adapted for application of insulation panels on an outer peripheral surface of the drum wall, said drum comprising:

(a) at least one channel member insulation panel end anchoring means, which channel member panel end anchoring means comprises a channel affixed to said drum wall with its open face against said drum wall, said channel member being positioned in an axial direction along said drum wall and containing ceramic fiber insulation within the channel; and (b) rib member insulation panel side anchoring means, which rib member panel side anchoring means comprises an angle having a leg affixed to said drum wall while extending circumferentially around said drum.

* * * * *

UNITED STATES PATENT AND TRADEMARK OFFICE

CERTIFICATE OF CORRECTION

PATENT NO. : 5,261,555

DATED : November 16, 1993

INVENTOR(S) : Rogers et al

It is certified that error appears in the above-identified patent and that said Letters Patent is hereby corrected as shown below:

Column 8, lines 22-24, in Claim 13, after "wall" at line 22, delete the phrasing ", said drum being adapted for application of insulation panels on an outer peripheral surface of the drum wall".

Signed and Sealed this

Seventeenth Day of May, 1994

*Attest:*

Bruce Lehman

BRUCE LEHMAN

*Attesting Officer*

*Commissioner of Patents and Trademarks*